US005750947A

United States Patent [19]

Rao et al.

[11] Patent Number: 5,750,947

[45] Date of Patent: May 12, 1998

[54] ROTARY ELECTRIC SWITCH WITH CONDUCTIVE PLATES

[75] Inventors: Chepur P. Rao, North Kingstown; Bryan A. Thurston, Johnston, both of R.I.

[73] Assignee: Tower Manufacturing Corporation, Providence, R.I.

[21] Appl. No.: 579,560

[22] Filed: Dec. 27, 1995

[51] Int. Cl.[6] ..... H01H 19/00; H01R 4/24

[52] U.S. Cl. ..... 200/6 R; 200/570; 439/441

[58] Field of Search ..... 200/6 R, 270, 200/570; 439/441

[56] References Cited

U.S. PATENT DOCUMENTS

| | | | |
|---|---|---|---|
| 2,705,785 | 4/1955 | Benander | 439/441 |
| 2,725,544 | 11/1955 | Strange | 439/441 |
| 2,813,158 | 11/1957 | Hutt | 200/6 R |
| 2,921,147 | 1/1960 | Hutt | 200/6 R |
| 3,748,419 | 7/1973 | Torrey et al. | 200/570 |

*Primary Examiner*—Stuart N. Hecker
*Attorney, Agent, or Firm*—Kriegsman & Kriegsman

[57] ABSTRACT

A rotary electric switch having push-in wire terminals includes a hollow plastic housing having a recessed base and a cover, the base having a plurality of wire receiving openings. A plurality of resilient stationary contacts are positioned in the base, each resilient stationary contact being generally Z-shaped and having a locking tongue at one end, an intermediate arm, and a spring finger at the opposite end from the locking tongue. Each resilient stationary contact is positioned in the base with its locking tongue overlying a wire receiving opening in a side wall in the housing. A rotatable contactor is mounted in the base between the spring fingers of the resilient stationary contacts. A plurality of conductive plates are disposed in the base, one conductive plate associated with each resilient stationary contact, each conductive contacting the resilient stationary contact at a location its intermediate arm and in addition preventing a wire inserted into the opening from touching the sidewall of the housing. The housing includes a number of projections and standoffs to provide adequate spacing between current carrying components on the switch.

9 Claims, 7 Drawing Sheets

ROTARY ELECTRIC SWITCH WITH CONDUCTIVE PLATES

BACKGROUND OF THE INVENTION

The present invention relates generally to rotary electric switches and, more particularly, to rotary electric switches with push-in wire terminals.

Rotary electric switches with push-in wire terminals, sometimes referred to as quick connect terminals, are well-known in the art and are widely used to control alternating current circuits for such applications as the speed control of fan motors.

Rotary electric switches with push-in wire terminals usually include a hollow housing. The housing is usually made of plastic and includes a recessed base and a cover member. A rotatable contactor is centered in the base and is controlled by a switch handle or shaft. A plurality of resilient stationary contacts are positioned edgewise in the base around the rotatable contactor for making and breaking the several circuits through the switch.

Each stationary contact is generally in the shape of a Z, where the ends of the Z represent a locking tongue and a spring contact finger which are joined together by an intermediate arm. The two bends in the Z shaped stationary contact, one where the locking tongue engages the intermediate arm and the other where the intermediate arm engages the contact finger, are supported in opposite pockets in the base so that the intermediate arm will flex slightly to distribute the bending stresses exerted on both the locking tongue and the spring finger.

The locking tongue on each stationary contact provides the switch with the capability of implementing the push-in wire terminals. In particular, a wire to be connected is pushed through a wire receiving opening formed in the base, the wire receiving opening being partially covered by the free end of the locking tongue of the stationary contact. Once forced through the wire receiving opening, the wire will displace the locking tongue away from the opening which enables the wire to be fed into the base. Once the wire is sufficiently pushed through the opening, the locking tongue engages the side of the wire and effectively locks the wire within the switch between the stationary contact and a sidewall of the housing. When a pulling force is exerted to remove the wire from the switch, the wire tends to carry the tongue with it so that the locking tongue is pushed harder against the wire wedging it against the side wall of the plastic housing, the force of the wedging pressure increasing in proportion to the pulling force exerted on the wire.

An example of a rotary electric switch with push-in-wire terminals may be found in U.S. Pat. No. 2,813,158 to P. Hutt, which patent is incorporated herein by reference.

The use of rotary electric switches with push-in wire terminals is desirable for two primary reasons. First, connecting the wires of the circuit into the switch is relatively simple. More specifically, the user simply inserts each wire through its associated wire receiving opening in the housing, the locking tongue serving to lock the wire within the switch and to preclude its removal. Second, the use of push-in wire terminals is relatively inexpensive when compared to the more complicated switches which are presently quite standard in rotary switches, such as spade terminals.

It has been found, however, that there are drawbacks associated with the use of rotary electric switches with push-in wire terminals. For example, the electrical connection made between a wire of the circuit to the switch is not always satisfactory. More specifically, over time, the electrical connection of the switch through the locking tongue may become ineffective. If the electrical connection of the wire to the switch is poor, the switch will not work in its intended manner. In addition, because the wire is made of a conductive material and consequently conducts heat when carrying current through it, if the wire touches the sidewall of the housing, the sidewall may heat up over the area of contact by the wire and melt, causing the housing to become distorted in shape, and, in turn, possibily causing the switch to malfunction.

SUMMARY OF THE INVENTION

It is an object of the present invention to provide a new and improved rotary electric switch.

It is another object of the present invention to provide a rotary electric switch which includes push-in wire type terminals.

It is yet another object of the present invention to provide a rotary electric switch as described above in which the wires that are inserted into the switch make a satisfactory connection.

It is still another object of the present invention to provide an electric switch as described above which is small in size but which avoids creepage problems.

It is a further object of the present invention to provide an electric switch as described above which includes a plastic housing and wherein the electric switch is constructed so as to reduce the likelihood that heat from the wires inserted with the switch will cause the plastic housing to melt.

It is a yet another object of the present invention to provide a switch as described above which can be mass produced, has a minimal number of parts, which is limited in size and can be very easily used.

Accordingly, there is provided an electric switch comprising a hollow housing, the hollow housing having a recessed base and a cover, the base having a plurality of wire receiving openings, a plurality of resilient stationary contacts positioned in the base, each resilient stationary contact being generally Z-shaped and comprising a locking tongue at one end, an intermediate arm, and a spring finger at the opposite end from the locking tongue, each resilient stationary contact being positioned in the base with its locking tongue overlying a wire receiving opening in a side wall in the housing, a rotatable contactor mounted in the base between the spring fingers of the resilient stationary contacts, and a plurality of conductive plates disposed in the base, one conductive plate associated with each resilient stationary contact and contacting its associated resilient stationary contact, wherein a wire may be inserted through a wire receiving opening in the base and will contact its associated resilient stationary contact at its locking tongue and will also contact its associated conductive plate, each conductive plate being disposed inside the base so as to prevent its associated wire from touching the sidewall of the base.

According to another feature of the invention, the housing is shaped so that the size of the switch can be reduced without a corresponding reduction in the surface area distance between current carrying components on the switch.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration of an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts.

DETAILED DESCRIPTION OF A PREFERRED EMBODIMENT

Figure 9:
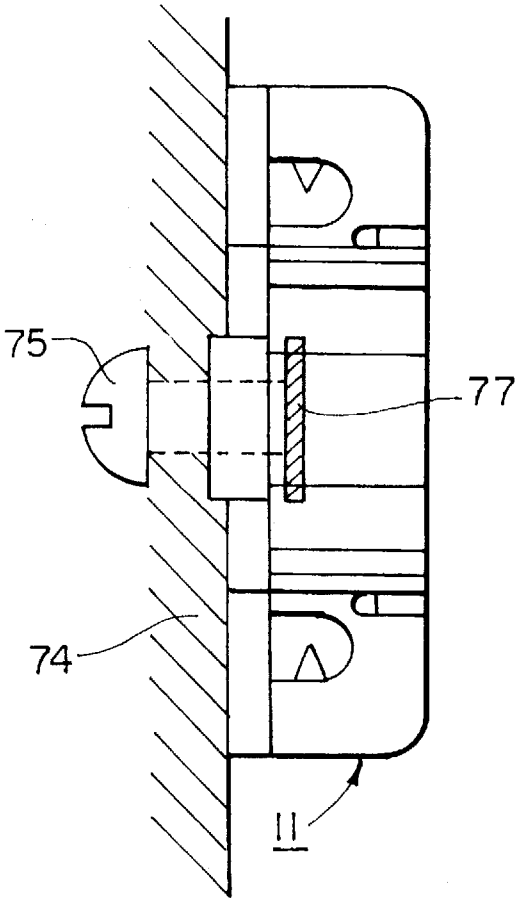
FIG. 9 is a section view showing the rotary electric switch of FIG. 1 attached to a mounting structure.
Figure 8:
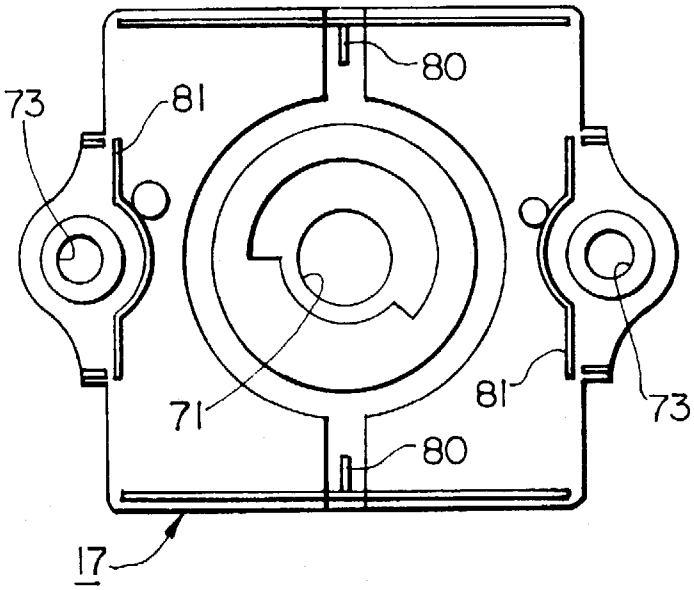
FIG. 8 is a bottom plan view of the cover shown in FIG. 2.

Referring now to the drawings, there is shown in FIGS. 1–4 a rotary electric switch constructed according to the teachings of the present invention and being represented generally by reference numeral 11. Portions of switch 11 are shown in FIGS. 5–8 and a side view showing switch 11 mounted on a wall of a device with which it may be used is shown in FIG. 9. Switch 11 comprises a hollow housing 13 constructed of plastic or other suitable insulating material. Housing 13 includes a recessed base 15 and a cover member 17; recessed base 15 and cover member 17 being permanently attached together, such as by ultrasonic welding.

Recessed base 15 is generally rectangularly shaped and includes a bottom wall 19 and four sidewalls 21, 23, 25 and 27. Sidewall 21 includes a pair of conductor wire-receiving openings 29 and 31 and sidewall 25, which is opposite sidewall 21, includes a pair of conductor wire receiving openings 33 and 35. Base 15 further includes a pair of first partitions 36-1 and 36-2 and a pair of second partitions 36-3 and 36-4.

Switch 11 further comprises four resilient stationary contacts 37-1 through 37-4 constructed preferably of bronze, one resilient stationary contact 37 being positioned at each corner of recessed base 15 between first partitions 36-1 and 36-2 and second partitions 36-3 and 36-4. Each resilient stationary contact 37 is generally Z-shaped and comprises a locking tongue 39 at one end, an intermediate arm 41, and a spring finger 43 at the opposite end from locking tongue 39. Locking tongue 39 is joined to arm 41 at a first bend 44-1 and arm 41 is joined finger 43 at a second bend 44-2.

Contact 37-1 is positioned in recessed base 15 between partition 36-1 and 36-4 so that the free end of its locking tongue 39 overlies conductor wire-receiving opening 31 and so that bend 44-1 extends around post 42. Locking tongue 39 includes a V-shaped groove 45 at the free end thereof, groove 45 facing outwardly towards opening 31. Resilient stationary contacts 37-2 through 37-4 are positioned at the other three corners of base 15 in a similar manner.

Switch 11 further comprises four conductive plates 47-1 through 47-4 constructed preferably of brass. Conductive plate 47-1 is seated inside base 15 along sidewall 23, between sidewall 21, partition 36-4 and locating post 48. Plate 47-1 is positioned so as to be in contact with contact 37-1 around bend 44-2. Plates 47-2 through 47-4 are seated in base 15 in a similar manner so as to be in contact with contacts 37-2, 37-3 and 37-4, respectively.

Figure 6:
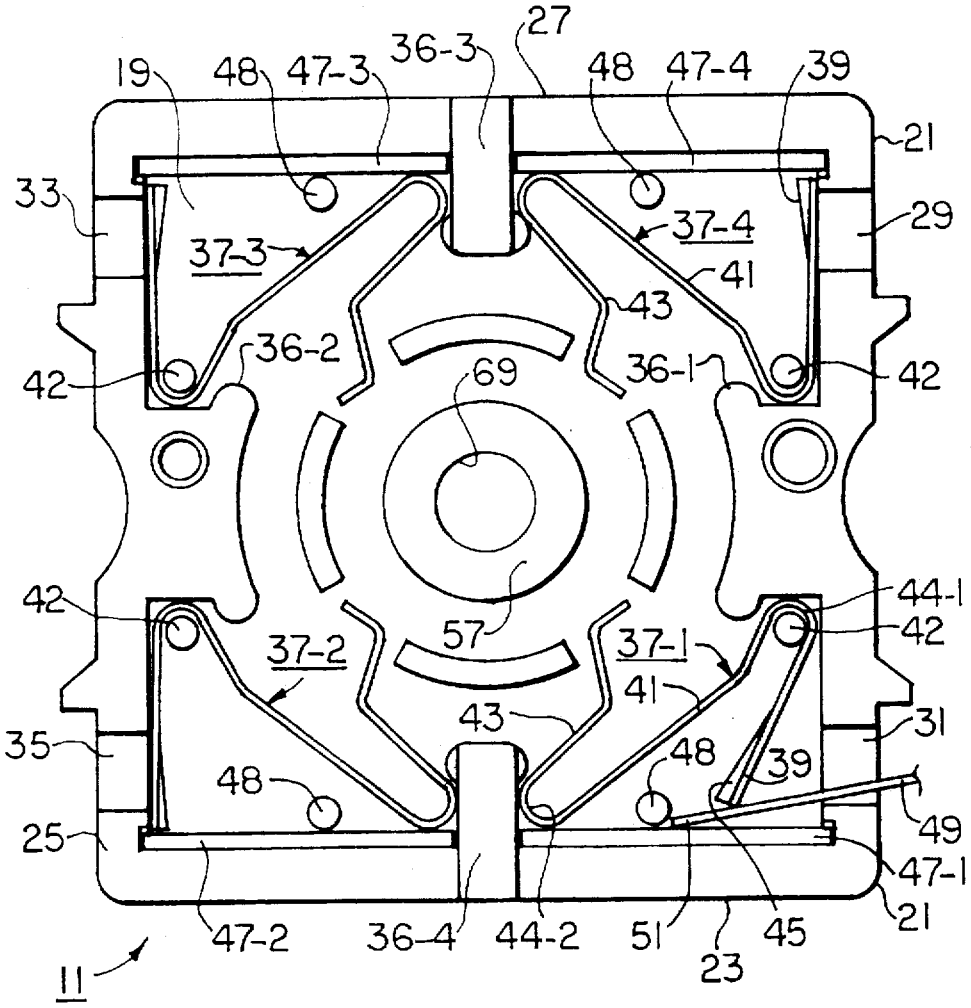
FIG. 6 is a top plan view of the base shown in FIG. 2 with the fixed contacts and conductive plates in place in the base and a wire inserted into one of the openings in the base.
Figure 7:
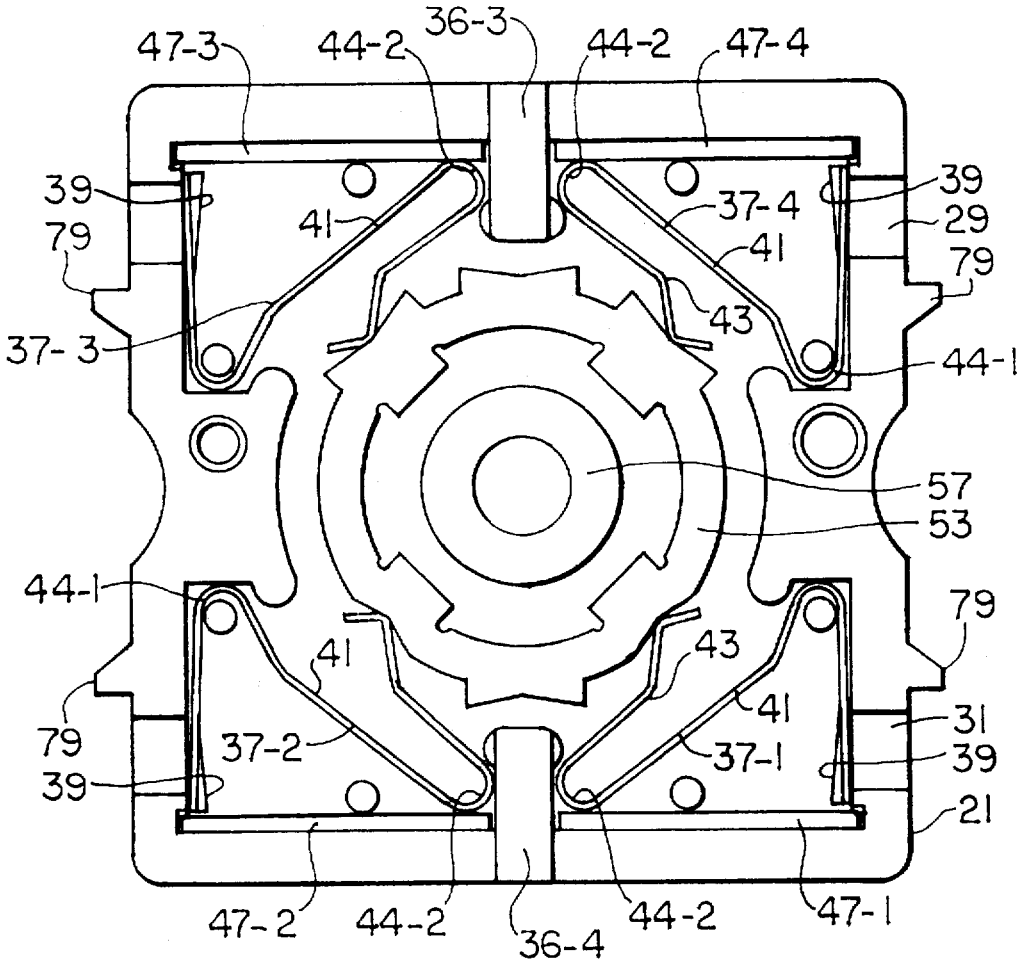
FIG. 7 is a top plan view of the base as shown in FIG. 2 with the fixed contacts, movable contact and conductive plates in place on the base before a wire is inserted into one of the openings on the base.

In use, a wire 49 which is to be coupled to contact 37-1 in switch 11 and having a tip 51 is inserted through conductor wire-receiving opening 31 in base 15. As can be seen, inserting wire 49 through opening 31 pivots locking tongue 39 inward as shown in FIG. 6, enabling wire 49 to be advanced through opening 23 with the tip of the V-shaped groove 45 of locking tongue 39 engaging the side of wire 49. V-shaped groove 45 serves as a guide means tending to hold wire 49 on the center line of locking tongue 39 during insertion. V-shaped groove 45 also acts as a point of contact between wire 49 and contact 37. When wire 49 is fully inserted through opening 31, it will be wedged between contact 37 and conductive plate 47 by locking tongue 39, with bend 44-2 contacting plate 47-1. Therefore wire 49 is always in contact, either directly or indirectly, with fixed contact 37-1 at two separate points, thereby insuring an improved connection.

As can be seen, conductive plate 47-1 also prevents tip. 51 of wire 49 from coming into contact with the inside surface 23-1 of sidewall 23.

Thus, conductive plate 47-1 serves two purposes, namely, to provide metal to metal contact on two sides of wire 49 and to prevent wire 49 from contacting the inside surface of sidewall 23.

With wire 49 inserted, any pulling force exerted to remove wire 49 out from switch 11 will cause locking tongue 39 to drag towards opening 31, thereby wedging wire 49 between locking tongue 39 and conductive plate 47. This wedging action locks wire 49 within switch 11 and prevents its removal.

Figure 1:
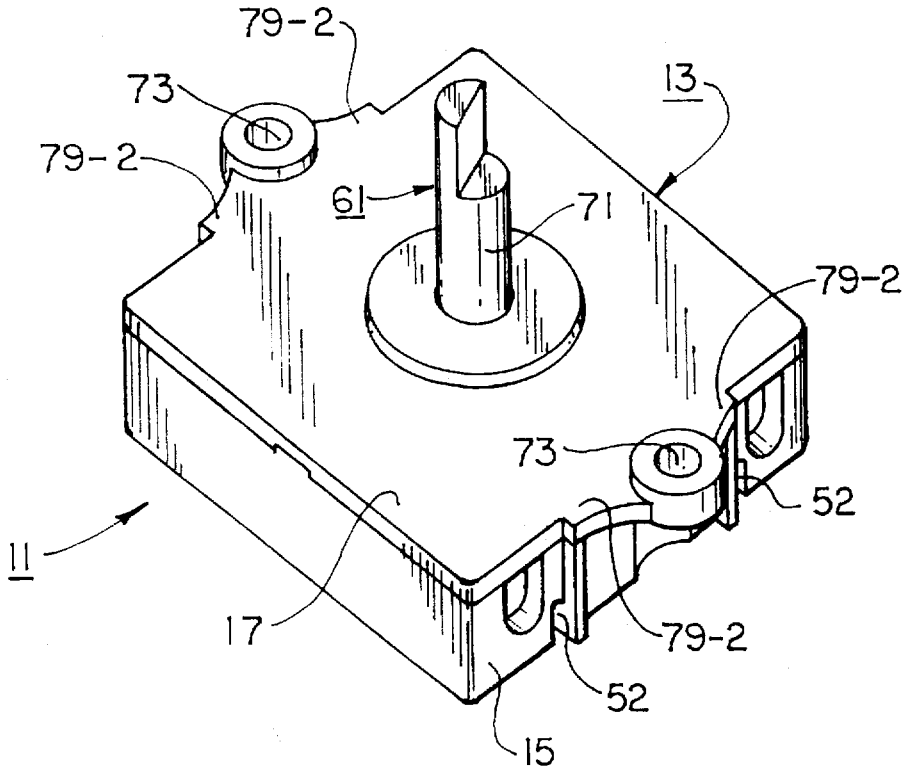
FIG. 1 is a perspective view of a rotary electric switch constructed according to FIG. 1.
Figure 2:
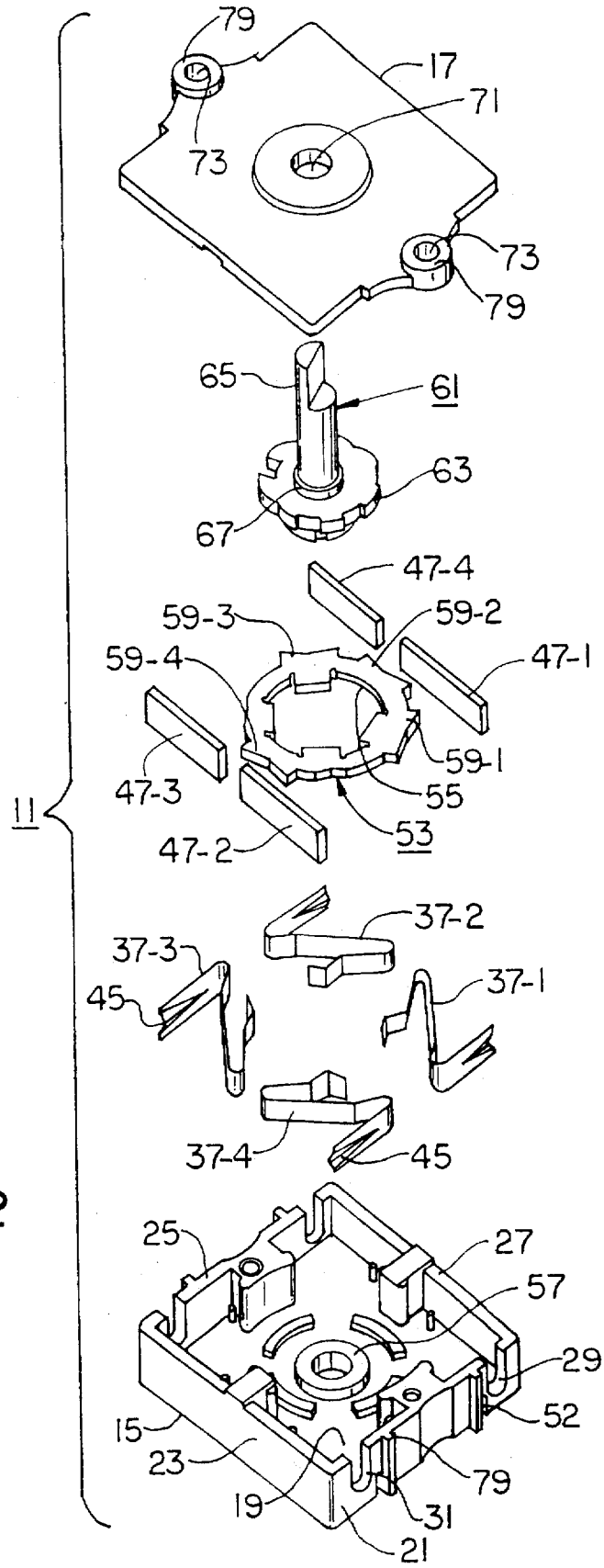
FIG. 2 is an exploded perspective view of the rotary electrical switch shown in FIG. 1.
Figure 3:
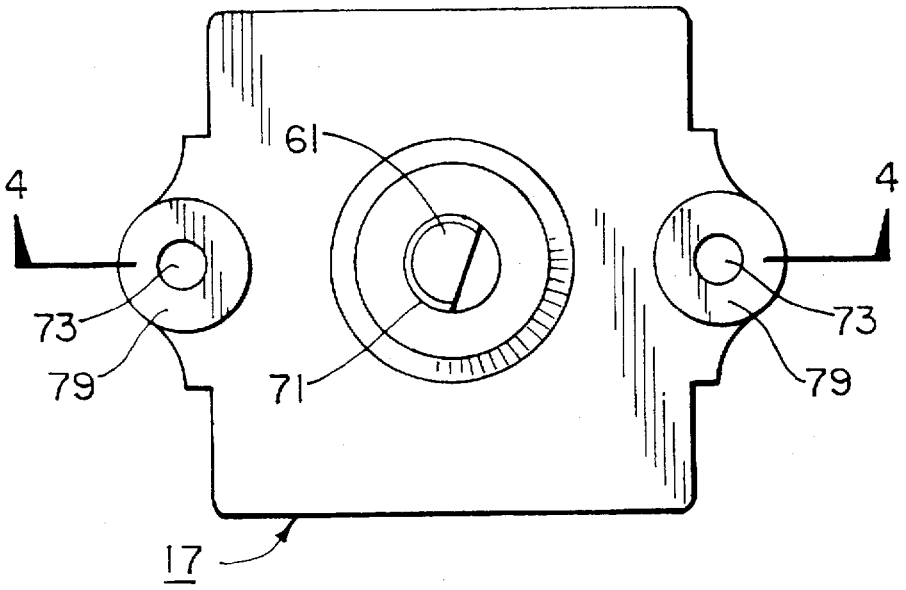
FIG. 3 is a top plan view of the rotary electric switch shown in FIG. 1.
Figure 4:
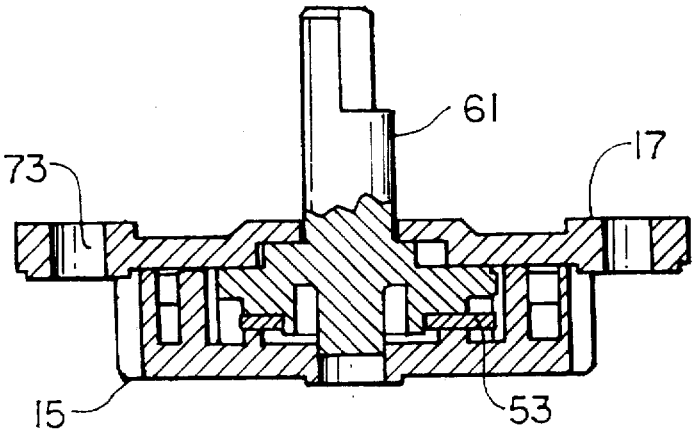
FIG. 4 is a sectional elevation view of the rotary electric switch shown in FIG. 1, taken along lines 4—4 in FIG. 3.

To permit the removal of wire 49 after it has been connected to switch 11, there is provided in the sidewall 21 of base 15 a release opening 52, as shown in FIG. 2. To release wire 49, the end of a suitable tool is passed through release opening 52 so that the tool is engagement with locking tongue 39. An inward push of the tool through opening 52 moves tongue 39 away from the locking engagement with wire 49, thereby allowing for the removal of wire 49.

Switch 11 further comprises a rotatable contactor 53 constructed of a conductive material such as brass. Rotatable contactor 53 is generally annular shaped and flat and comprises a central opening 55. Opening 55 is of a size to fit over an annular boss 57 on bottom wall 19 of base 15. In addition, there are four contact projections 59-1 through 59-4 integrally formed onto contactor 53. Projections 59 serve the purpose of making or breaking a connection with spring fingers 43 of stationary contacts 37 to form a closed or open circuit, respectively.

Switch 11 further comprises a switch handle 61 constructed out of a material such as plastic. Switch handle 61 comprises a cam portion 63 and a shaft 65. Cam portion 63 is engageable with rotatable contactor 53 and includes a cylindrical projection 67. Cylindrical projection 67 is pivotally mountable into a bore 69 located in the center of annular boss 57. Rotatable contactor 53 and switch handle 61 are held in switch 11 by cover member 17, with shaft 65 extending through a central opening 71 in cover member 17.

Cover member 17 of housing 13 comprises a pair of mounting holes 73. Mounting holes 73 enable switch 11 to be mounted onto a wall 74 of a device with which the switch 11 is to be used, such as by a screw 75 and a washer 77. Since screw 75 and washer 77 are generally constructed of metal, there runs a safety risk if screw 75 or washer 77 are in close proximity with conductive wire 49, since wire 49 may carry a sizable current. As a consequence, housing 13 of switch 11 comprises a plurality of projections 79. Projections 79 increase the surface area distance between screw 75 and wire 49 as well as the surface area distance between washer 77 and wire 49, thereby remedying a serious electrical hazard as well as satisfying safety standards. Projections 79 allow for the increase of the surface area distance between conductive materials without significantly increasing the overall size of switch 11.

Cover member 17 further comprises energy directors 80 and 81, i.e. elongated projections, on its inside surface. In the process of ultrasonically welding cover member 17 to recessed base 15, energy directors 80 and 81 melt into a liquid and flow so as to permanently bond cover 17 and base 15 together as a one piece molding with no air gaps. Also, because energy directors 80 and 81 are positioned onto first and second partitions 36-1 thru 36-4, fixed contacts 37 are more effectively isolated, thereby limiting the electrical dangers which may occur when two conductive pieces of material approach one another.

Figure 5:
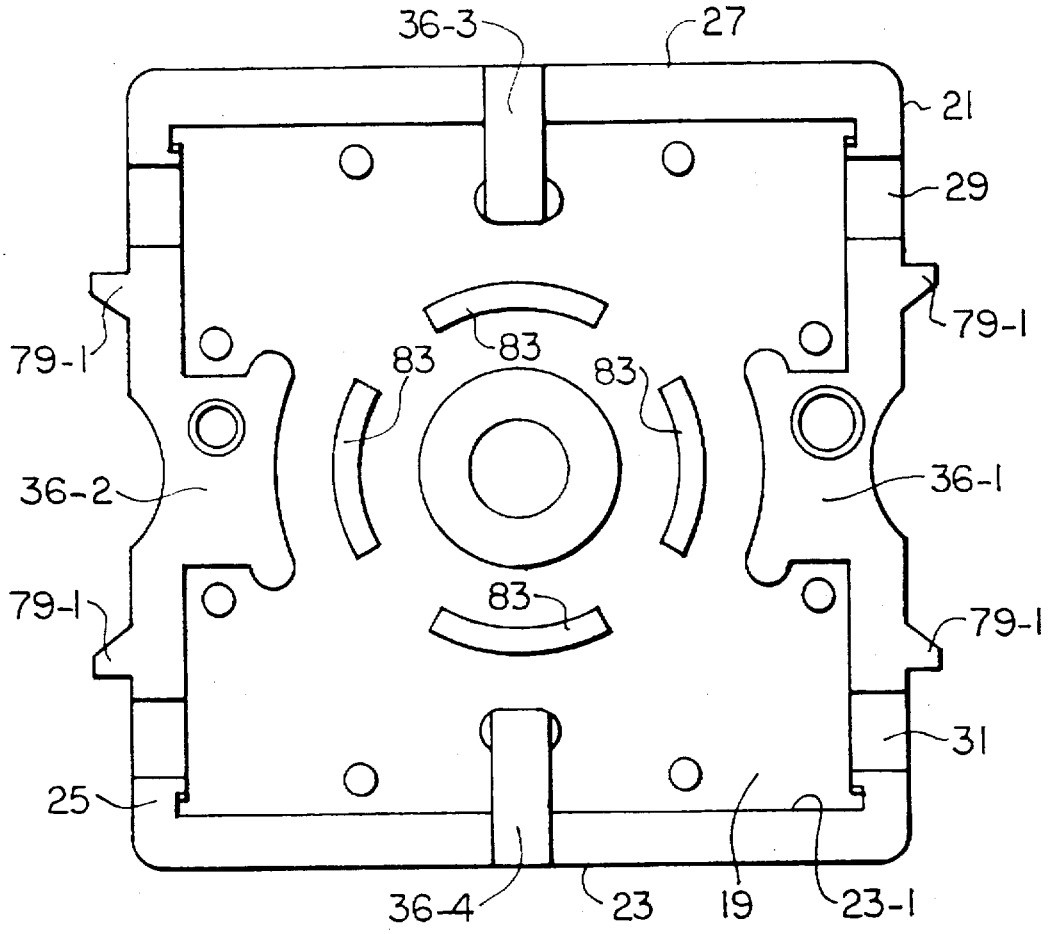
FIG. 5 is a top plan view of the base shown in FIG. 2.

As can be seen in FIG. 5, there are shown a plurality of arcuate projections 83 integrally formed on the bottom wall of recessed base 15. Arcuate projections 83 serve the function of pushing rotatable contactor 53 up onto engagement with cam portion 63 of switch handle 61. Projections 83 therefore prevent rotatable contactor 53 from falling down off of cam portion 63 of handle 61 as a result of heat or shock within switch 11.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A rotary electric switch comprising:

a. a hollow housing, said hollow housing having a recessed base and a cover, said base having a plurality of wire receiving openings;

b. a plurality of stationary contacts seated on the base, each stationary contact being generally Z-shaped and comprising a locking tongue at one end, an intermediate arm, and a spring finger at the opposite end from the locking tongue, each stationary contact being positioned in said base with its locking tongue overlying a wire receiving opening in said housing;

c. a rotatable contactor mounted in the base between the spring fingers of said fixed contacts; and d. a plurality of conductive plates seated in said base, one conductive plate associated with each stationary contact and contacting said fixed contact at a location on said intermediate arm;

e. wherein a wire may be inserted through a wire receiving opening in the base and will contact its associated fixed contact at its locking tongue and will also contact its associated conductive plate.

2. The rotary electric switch as claimed in claim 1 wherein said housing is made of plastic and includes a bottom wall and a plurality of sidewalls and wherein said conductive plates are positioned in said base to prevent a wire from touching said sidewalls.

3. The rotary electric switch as claimed in claim 2 wherein the cover of said hollow housing comprises one or more mounting holes for attaching said switch to a mount structure.

4. The rotary electric switch as claimed in claim 3 wherein said hollow housing further comprises one or more projections positioned between the mounting holes in the cover of said housing and the wire receiving openings in the base of said housing.

5. The rotary electric switch as claimed in claim 4 wherein the recessed base in said hollow housing further comprises a plurality of arcuate projections positioned directly underneath said rotatable contactor.

6. The rotary switch as claimed in claim 5 wherein said recessed base further comprises one or more slots or posts for mounting said plurality of conductive plates.

7. The rotary switch as claimed in claim 6 wherein said recessed base further comprises one release hole for each wire receiving opening, the release hole enabling for the removal of a wire from said switch.

8. The rotary switch as claimed in claim 7 wherein the cover of said hollow housing comprises a plurality of energy directors on the surface thereof, the energy directors providing locations to permanently weld said recessed base and cover together ultrasonically.

9. The rotary switch as claimed in claim 8 wherein there are four stationary contacts and four conductive plates.

* * * * *